United States Patent [19]

Klimek et al.

[11] 4,037,907

[45] July 26, 1977

[54] TRACTOR-TRAILER ELECTRICAL RECEPTACLE

[75] Inventors: Boleslaw M. Klimek, Des Plaines; Victor Mastis, Hinsdale, both of Ill.

[73] Assignee: The Echlin Manufacturing Company, Branford, Conn.

[21] Appl. No.: 660,491

[22] Filed: Feb. 23, 1976

[51] Int. Cl.[2] ..... H01R 13/52; H01R 13/60

[52] U.S. Cl. ..... 339/126 R; 339/44 M

[58] Field of Search ..... 339/10, 36, 39, 44 R, 339/44 M, 126 R

[56] References Cited

U.S. PATENT DOCUMENTS

| | | | |
|---|---|---|---|
| 2,593,182 | 4/1952 | Quackenbush | 339/44 M X |
| 3,284,753 | 11/1966 | Goldbaum et al. | 339/44 R |

*Primary Examiner*—Roy Lake

*Assistant Examiner*—E. F. Desmond

*Attorney, Agent, or Firm*—Neuman, Williams, Anderson & Olson

[57] ABSTRACT

A tractor-trailer electrical receptacle is disclosed wherein a housing contains a cavity having a plurality of male contact members mounted therein; the cavity is adapted for receiving a mating electrical plug. A mounting member connected to the housing is adapted for mounting the housing at an angle inclined to the horizontal to promote drainage of any moisture in the cavity away from the contact members. A support member extends forwardly from the housing to provide such support for an electrical plug mated with the receptacle as minimizes the effects of vehicle vibration upon such plug. A cover is connected to said housing and urged by a spring to close the cavity when a plug is not inserted in the receptacle.

10 Claims, 4 Drawing Figures

TRACTOR-TRAILER ELECTRICAL RECEPTACLE

This invention relates to an electrical connector apparatus and more particularly to an electrical receptacle suitable for use in tractor-trailer combinations.

In a coupled tractor-trailer combination it is necessary to communicate a plurality of electrical signals between the tractor and the trailer. It has been known to provide specialized electrical connector assemblies including a plug and a receptacle for interconnecting cables used to effect the communication of these signals. Such assemblies are disclosed in U.S. Pat. No. 3,284,753 issued Nov. 8, 1966 to E. Goldbaum et al., U.S. Pat. No. 3,887,256 issued June 3, 1975 to B. Klimek et al., and a copending application of B. Klimek et al., Ser. No. 581,371, filed May 27, 1975. These assemblies have been effective to provide the necessary electrical interconnection of cables between a tractor and a trailer; in addition, the structures shown in the above noted Klimek patent and application have also been effective to minimize the collection of moisture adjacent contact members in such receptacles by inclining the receptacle housing to promote drainage away from contacts therein.

This invention is an improvement over the receptacles shown in the above-mentioned Klimek patent and application in that a receptacle according to this invention not only minimizes the above-mentioned moisture effects but it also minimizes the effects of vibration inherent in the tractor-trailer environment upon a plug coupled to the receptacle.

More specifically, it is an object of this invention to provide an improved electrical receptacle which minimizes effects of vibration upon an electrical plug mated with such receptacle.

It is a more specific object of the invention to provide an electrical receptacle having a housing including a support member adapted for providing such support to a plug coupled to such connector as minimizes vehicle vibration effects on the plug.

These and other objects and features of the invention will become apparent in the following specification and claims in view of the attached drawings.

In one illustrative embodiment of the invention, an electrical receptacle comprises a housing having a capacity therein with an opening in at least one end; mounted in the cavity are a plurality of electrical contact members which are adapted for coupling to individual wires of an electrical cable. The housing is connected to a mounting member which is adapted for mounting the receptacle to a substantially vertical wall. A support member of the housing extends substantially forwardly from the body of the housing toward the open end providing a support surface for any plug which may be mated with the receptacle.

For a more complete understanding of this invention, reference should now be had to the embodiment illustrated in the accompanying drawings and described by way of an example of the invention.

IN THE DRAWINGS

DETAILED DESCRIPTION OF THE ILLUSTRATIVE EMBODIMENT

Figure 1:
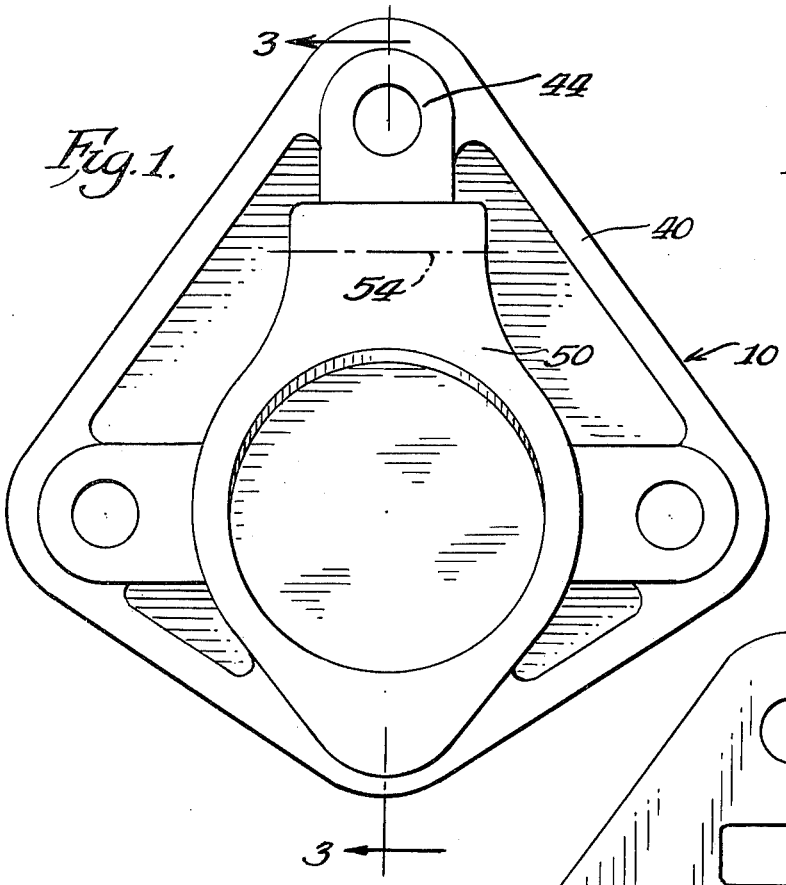
FIG. 1 shows a front view of an illustrative receptacle embodying principles of this invention.
Figure 4:
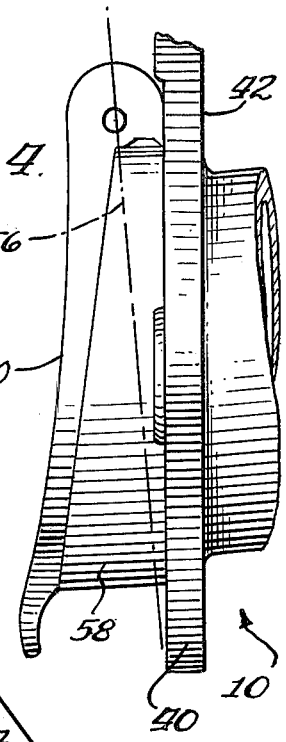
FIG. 4 shows a fragmentary side view of the electrical receptacle shown in FIG. 1.
Figure 2:
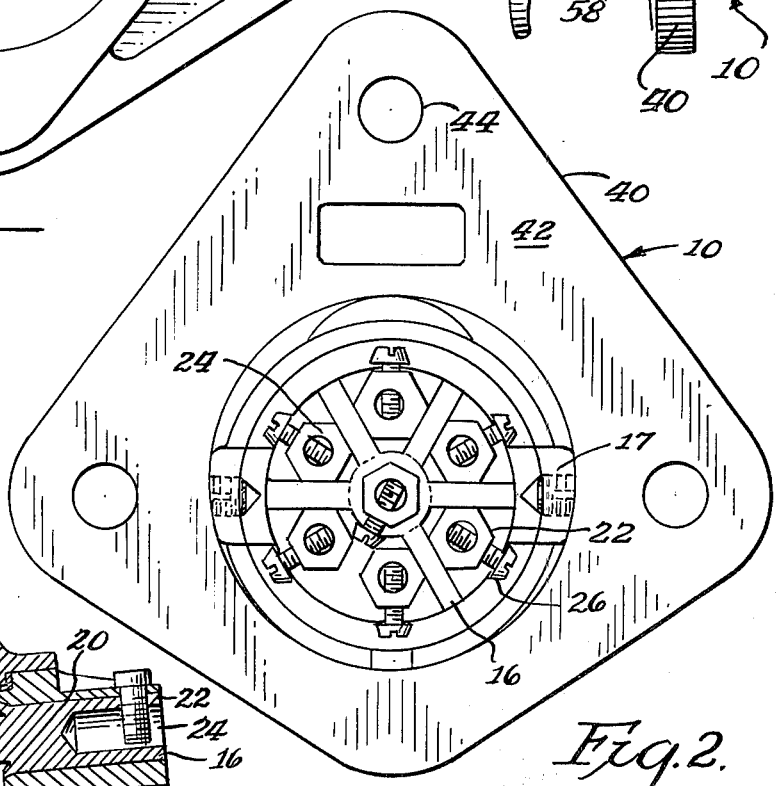
FIG. 2 shows a rear view of the electrical receptacle shown in FIG. 1.

Referring to FIGS. 1 - 4, an electrical receptacle according to the present invention is shown generally at 10. The receptacle includes a housing 12 having an elongated cylindrical cavity 14 therein. The cavity 14 is open on both ends; however, a contact support member 16 is mounted in the rearward end of the housing 12 by screws 17; the contact support member 16 and a generally "L" shaped, annular seal 18 together close the rearward opening of the cavity 14. The contact mounting member 16 includes a plurality of openings 20 for receiving a plurality of contact members 22 in a tight, pressed fit. These contact members include cylindrical cavities rearwardly therein for receiving wires (not shown) from a connecting cable. Contact screws 26 are mounted in threaded holes 28 in the contact support and contact members and serve to retain the afore-mentioned wires in the cavities 24.

The substantially cylindrical cavity 14 has a principal axis 34. The axis 34 serves as the axis along which a mating plug of the type disclosed in the above-mentioned Klimek patent is inserted into the receptacle 10. The disclosure of the Klimek et al., patent is incorporated herein by reference.

Figure 3:
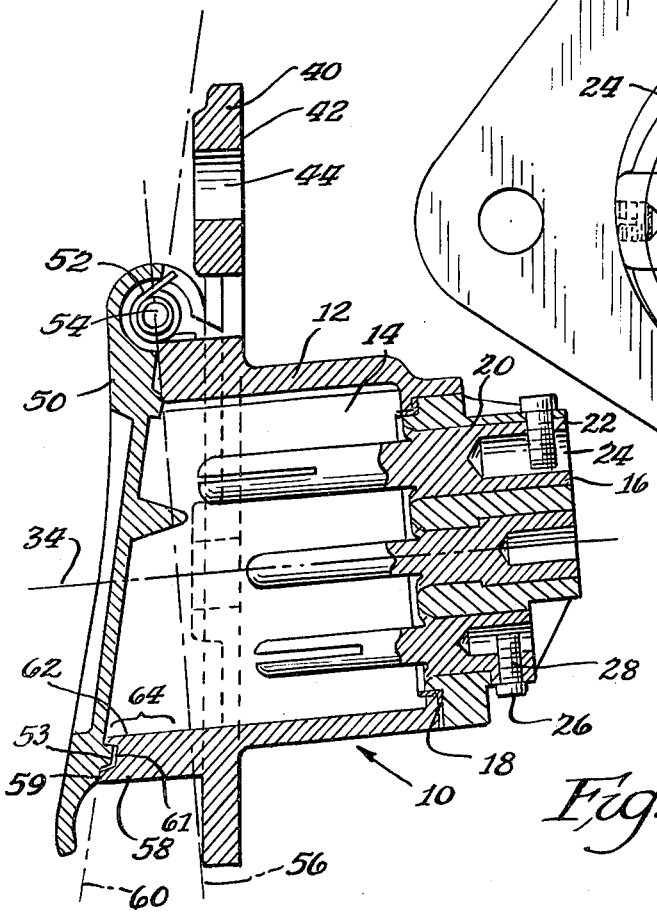
FIG. 3 shows a cross-section of the electrical receptacle shown in FIG. 1 along the line 3—3 in the direction of the arrows.

A mounting member 40 is coupled to the housing 12; it may be connected to the housing or may be formed integrally therewith. The mounting member 40 includes a planar, rearward, mounting surface 42 and a plurality of mounting holes 44. The mounting surface 42 and mounting holes 44 are adapted to cooperate with mounting bolts (not shown) to support the receptacle 10 on a substantially vertical member. It should be noted that the support surface 42 forms an angle other than 90° (differing by approximately 5°) with the axis 34. As a result, when the receptacle 10 is mounted on a substantially vertical member (as seen in FIG. 3), the cavity 14 is inclined with respect to the horizontal such that moisture within the cavity 14 is drained under the influence of gravity toward the forward opening of the cavity and away from the contact members 22.

At the forward end of the housing, a cover 50 is connected to the housing and urged by a spring 52 to close the forward opening of the cavity 14 when a plug is not mated with the receptacle. The cover is hinged about an axis 54 and includes an annular rib 53.

The housing 12 may be viewed (as is known in the prior art, e.g., the Klimek et al., patent) as extending forwardly substantially to a plane (represented by a line 56 in FIG. 3) perpendicular to two spatial axes to the principal axis 34 of the cavity 14 passing through the cover rotation axis 54. However, in the preferred embodiment of this invention, an annular plug support member 58 extends forwardly from the plane of the line 56 to an end surface 59 in a plane (represented by a line 60 in FIG. 3) also passing substantially through the axis 54; the plane 60 and the plane 56 are significantly angularly separated (in the preferred embodiment by approximately 7°). Thus, the plane of the end surface 59 of the plug support member 58 forms an angle significantly other than 90° with respect to the principal axis 34. It should be noted, however, that other forms of this invention are contemplated in which the surface 59 is not itself in a plane significantly other than 90° to the axis 34 but includes an element(s) which is in such a plane. The end surface 59 of the annular plug support member 58 includes an annular groove 61 for receiving the rib 53.

The member 58 provides an inner surface 62 adapted to engage a plug which may be mated with the receptacle 10 and provide substantial additional support to such plug beyond that which would be provided by the housing 12 without such member. The inner surface 62 has a length 64 parallel to the axis 34 which increases from a minimum at or near the top (as viewed in FIG. 3) of the forward opening of the cavity 14 to a maximum at the bottom of that forward opening. It is contemplated, however, that any other form of support member may be employed which is adapted to engage the surface of a plug, mated with the receptacle, over more of its length than would be the case with the body of the housing (i.e., that portion of the housing rearward of the line 56) alone even though extending arcuately less than fully around the plug. In addition, while the annular plug support member is, in the preferred embodiment, an extension from the body of the housing, the function of the member 58 could be well served by a member distinct from the housing but attached thereto by various means.

The above description is directed to a specific preferred and illustrative embodiment of the invention. It is not intended, however, that the invention be limited to this illustrative embodiment; rather, those skilled in the art to which this invention pertains will recognize numerous additional embodiments of the principles of this invention upon reading this disclosure. Therefore, it is intended to encompass within his invention that which is within the true spirit and scope of the following claims.

What is claimed is:

1. An electrical receptacle comprising a housing including a cavity therein having a principal axis, contact means mounted at least partially within said cavity, said housing having a first end and said cavity being open at said first end, said first end of said housing having a substantially planar end surface at an angle significantly other than 90° to said principal axis of said cavity.

2. An electrical receptacle as in claim 1 further comprising mounting means connected to said housing, said mounting means being adapted to mount said housing on a vertical member with said principal axis inclined to the horizontal; and wherein said contact means comprise a plurality of contact members mounted in said housing rearwardly of said cavity.

3. An electrical receptacle as in claim 2 further comprising a cover for said open cavity at said first end.

4. An electrical receptacle as in claim 3 further comprising spring means for urging said cover to close said opening of said cavity; and wherein said substantially planar first end includes an annular groove and said cover includes a mating annular rib.

5. An electrical receptacle according to claim 1 further comprising cover means for covering said open end of said cavity at said first end, said cover means including an annular rib and said end surface including an annular groove for receiving said annular rib.

6. An electrical receptacle according to claim 5 wherein said cavity is of substantially cylindrical form; and further comprising mounting means adapted for mounting said housing with said principal axis inclined to the horizontal.

7. An electrical receptacle comprising a housing having a cavity therein, said cavity having a principal axis and being open on one end of said housing, electrical contact means mounted in said housing, cover means rotatably mounted about a rotation axis at said one end of said housing, said housing including a support portion extending toward said one end substantially beyond a plane perpendicular in two directions to said principal axis and passing through the opening of said cavity, said support portion being adapted to provide support to a plug which may be mated with said receptacle.

8. An electrical receptacle as in claim 7 wherein said cavity is substantially cylindrical in form and said cover means includes a cover and spring means for urging said cover into a position over said opening.

9. An electrical receptacle apparatus comprising a housing having a cavity formed by a wall extending within said housing, said cavity having a principal axis and an opening at one end of said housing, contact means mounted at least partially within said cavity, said housing having at said one end at least one portion about said cavity with an element in a plane forming an angle other than 90° with respect to the axis of said cavity such that the extension of said wall within said housing varies from at least a first dimension to at least a second dimension greater than said first dimension.

10. An electrical receptacle as in claim 9 further comprising a cover means mounted at said one end of said housing for covering said opening and mounting means adapted for mounting said receptacle.

* * * * *